US006115949A

United States Patent [19]

Kremer

[11] Patent Number: 6,115,949

[45] Date of Patent: Sep. 12, 2000

[54] STEAM IRON DRIP VALVE ACTUATOR

[75] Inventor: Ralf Kremer, Seligenstadt, Germany

[73] Assignee: Rowenta-Werke GmbH, Offenbach a.M., Germany

[21] Appl. No.: 09/446,255

[22] PCT Filed: Jun. 4, 1998

[86] PCT No.: PCT/DE98/01526

§ 371 Date: Dec. 20, 1999

§ 102(e) Date: Dec. 20, 1999

[87] PCT Pub. No.: WO98/58115

PCT Pub. Date: Dec. 23, 1998

[30] Foreign Application Priority Data

Jun. 18, 1997 [DE] Germany ..... 297 10 625 U

[51] Int. Cl.[7] ..... D06F 75/18

[52] U.S. Cl. ..... 38/77.8

[58] Field of Search ..... 38/77.4, 77.7, 38/77.8, 77.83, 90, 91, 92; 251/227, 251, 318, 320

[56] References Cited

U.S. PATENT DOCUMENTS

| | | | |
|---|---|---|---|
| 2,342,653 | 2/1944 | Edwards . | |
| 2,887,800 | 5/1959 | Kistner | 38/77.7 |
| 2,906,043 | 9/1959 | Jepson et al. | 38/77.83 |
| 2,976,627 | 3/1961 | Kistner et al. | 38/77.83 |

FOREIGN PATENT DOCUMENTS

| | | |
|---|---|---|
| 21 27 94 | 1/1961 | Austria . |
| 35 10 993 | 10/1986 | Germany . |
| 39 42 969 | 7/1991 | Germany . |

*Primary Examiner*—Ismael Izaguirre

*Attorney, Agent, or Firm*—Cohen, Pontani, Lieberman & Pavane

[57] ABSTRACT

The invention provides a drip valve having few parts. The drip valve is arranged between the water tank and the evaporation chamber. An adjustment part is mounted in the handle and has an eccentric and helical sliding track with latching grooves. The adjustment part is formed as a wheel segment with bearing pins. The valve includes a valve rod with an angled end. The angled end of the valve rod is engageable in the latching grooves so as to hold the rod and valve in place.

3 Claims, 2 Drawing Sheets

STEAM IRON DRIP VALVE ACTUATOR

BACKGROUND OF THE INVENTION

1. Field of the Invention

The invention relates to a steam iron.

2. Discussion of the Prior Art

The known steam irons generally comprise a heated sole plate having an evaporation chamber and a water tank, from which water is fed into said evaporation chamber in order to produce steam. It is expedient for it to be possible to adjust the quantity of steam in conjunction with the correct sole-plate temperature in accordance with the articles to be ironed. For this purpose, the water is directed, via a drip valve, into the evaporation chamber, which can have the cross section of its opening changed, as a result of which the drip rate of the water flowing through can be adjusted and the quantity of steam can thus be varied. In order to adjust the cross section of the opening, a conically tapered valve rod is generally guided in a throughflow opening in a vertically adjustable manner. When the valve rod is moved down to the full extent, the through-flow opening is closed, and, when the valve rod is in the raised position, the maximum throughflow is released.

German Patent 39 42 969 discloses a steam iron in which the valve rod is supported on a fixed curve track by a pin. Rotation of the valve rod raises or lowers the same in the vertical direction. This known steam iron has the disadvantage that the drip device comprises a number of parts and, on account of its construction, is difficult to integrate in a modern, streamlined handle design.

SUMMARY OF THE INVENTION

The object of the invention is to avoid the abovementioned disadvantages and to provide a drip device which, with a minimal number of parts, allows a valve rod to be activated and, at the same time, allows integration in a modern iron handle.

Pursuant to this object, and others which will become apparent hereafter, one aspect of the present invention resides in a steam iron having a water tank and an evaporation chamber. A drip valve is arranged between the water tank and the evaporation chamber so as to feed water from the water tank to the evaporation chamber in order to produce steam. The drip valve has a valve rod with an angled end. An adjustment part is mounted in the handle and operatively connected to the valve rod. The adjustment part is formed as a wheel segment having bearing pins and a sliding track which acts as a guide for the angled end of the valve rod. The sliding track is eccentrically and helically arranged in relation to the bearing pins and has latching grooves. The angled end of the valve rod is engagable in the latching grooves so as to hold the rod and valve in place.

This achieves the situation where one end of the valve rod is in operative connection with an adjustment part which is designed as a wheel segment and is mounted obliquely in the iron handle, with the result that merely a grip part which is integrally formed on the adjustment part projects laterally out of the handle contour. The adjustment part is mounted, by way of the pins integrally formed on it, on bearing blocks, which are formed as a constituent part of the water tank and/or of the handle. The adjustment part is provided with a spatially obliquely running guide which is eccentric in relation to the pins. The guide is configured, as far as its track is concerned, such that the angled end of the valve rod can be supported in it. By virtue of the adjustment part being rotated, the guide acts in the manner of an eccentric and raises and lowers the valve rod in dependence on the direction of rotation. As a result, the drip valve is either closed or opened to an increasing extent until a maximum end point is reached. The displacement path is defined by the angle of rotation of the adjustment part. Upward movement of the valve rod simultaneously stresses a restoring spring, which allows sliding in the downward direction if the direction of rotation is reversed. Latching grooves for receiving the angled end of the valve rod are arranged on the guide. This means that the valve rod can be arrested in a certain vertical position and it is thus possible to adjust a desired quantity of steam.

BRIEF DESCRIPTION OF THE DRAWINGS

An exemplary embodiment of the invention is described in more detail hereinbelow and is illustrated in the drawings, in which.

DETAILED DESCRIPTION OF THE PREFERRED EMBODIMENTS

Figure 1:
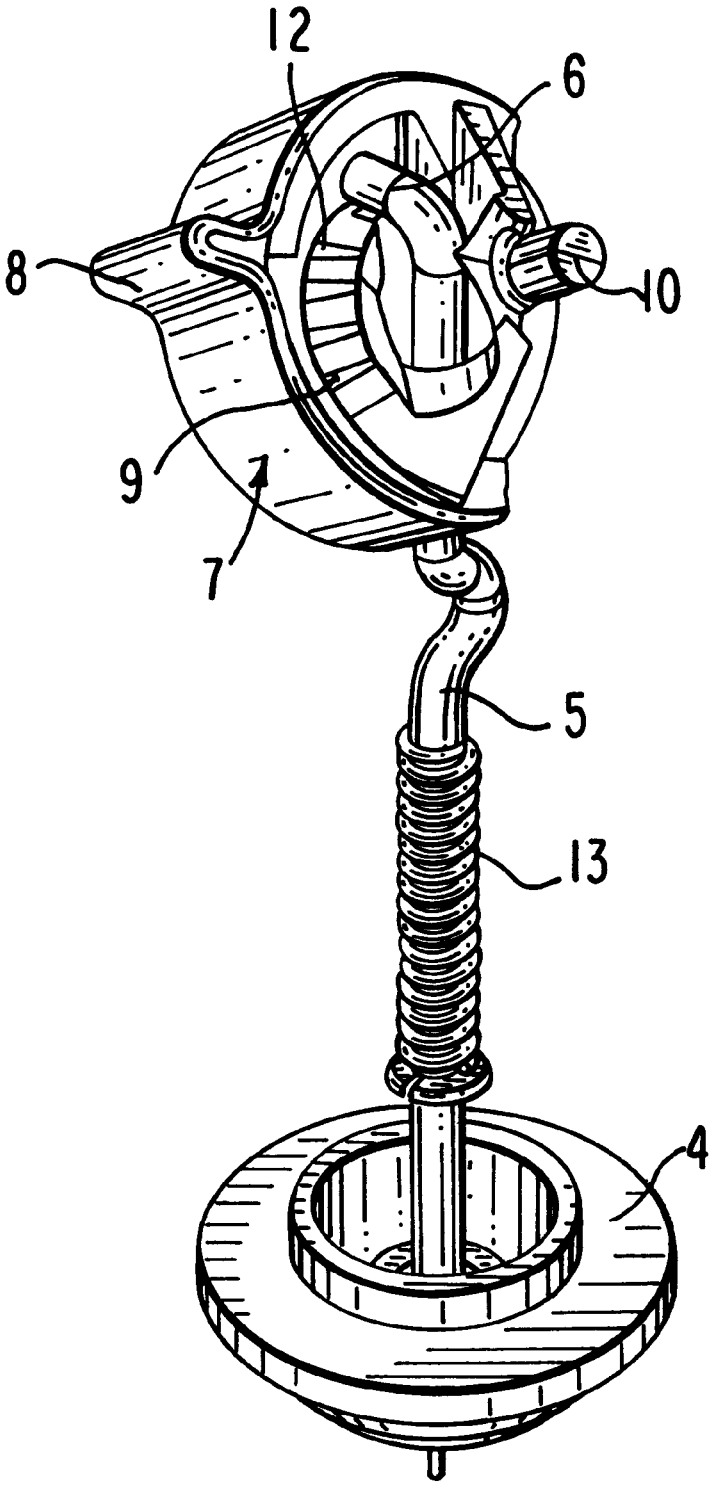
FIG. 1 shows the drip valve according to the invention.
Figure 2:
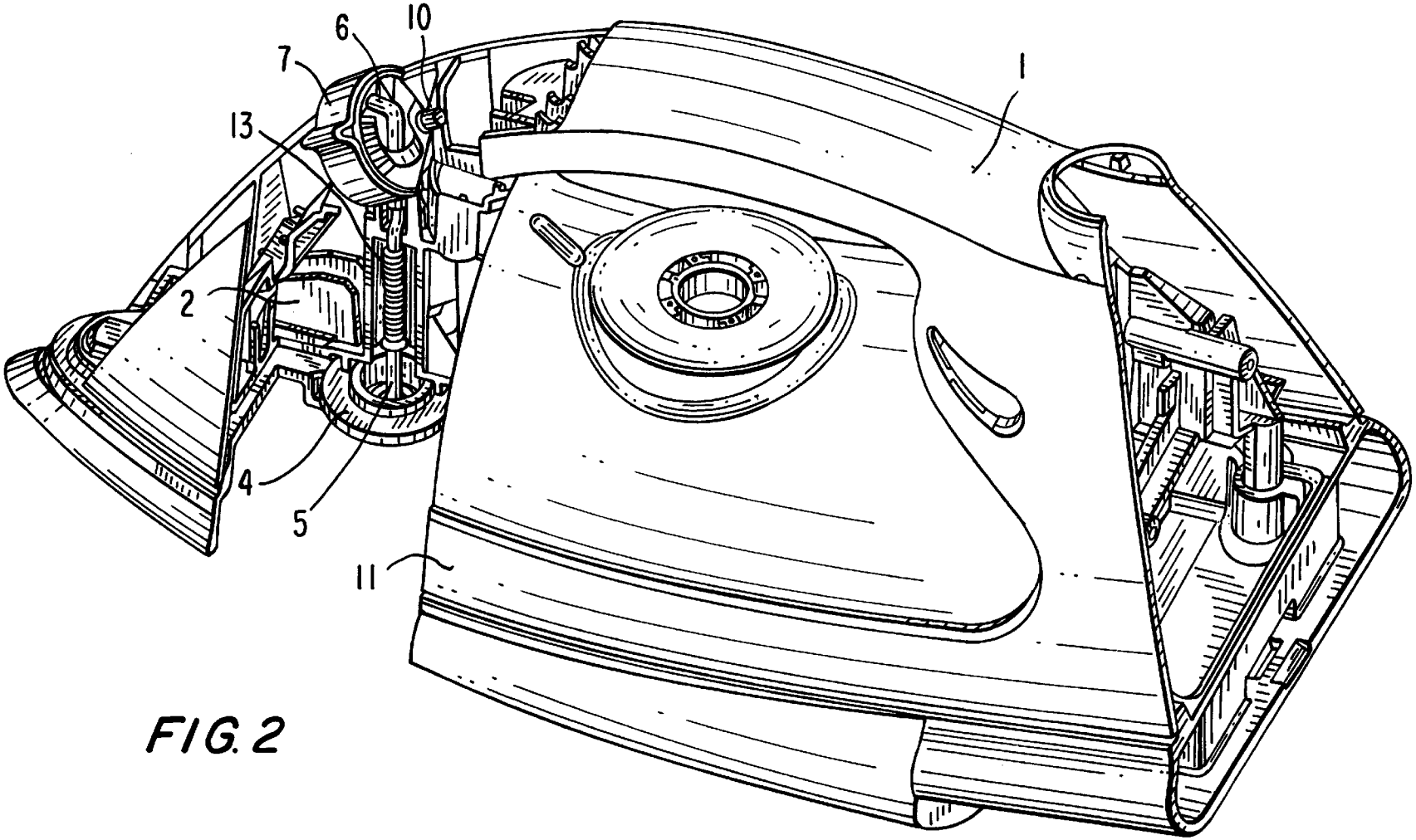
FIG. 2 shows the drip valve according to the invention in the installed state, in section.

FIG. 1 illustrates the drip valve 4 according to the invention. The drip valve 4 has a valve rod 5 which, in the region of its angled end 6, is in operative connection with an adjustment part 7. The adjustment part 7 is provided with a grip part 8 and a helical sliding track 9 as a guide for the end 6 of the valve rod 5. The sliding track 9 has latching grooves 12 for receiving the angled end 6 of the valve rod 5. The sliding track 9 is designed helically and eccentrically in relation to the bearing pins 10 integrally formed on both sides of the adjustment part 7. The adjustment part 7 is mounted obliquely, via its bearing pins 10, in the handle 1 of the steam iron 11. Self-locking latching of the valve rod 5 is achieved as a result of the latching grooves 12 and a prestressing spring 13, which is mounted on housing parts and grips over the valve rod 5. FIG. 2 shows the drip valve 4 according to the invention in the installed state.

By virtue of the adjustment part 7 being rotated, with the aid of the grip part 8 integrally formed on it, about its bearing pins 10, integrally formed on it, the valve rod 5 is raised or lowered in dependence on the direction of rotation of the adjustment part 7, and the drip valve is thereby closed or opened to a greater or lesser extent. The valve rod 5 is mounted in the latching grooves 12 by way of its angled end 6, with the result that the valve rod 5 can be vertically raised or lowered with great precision and arrested in a certain position. As a result, the feed of water from the water tank 2 into the evaporation chamber, and thus a desired quantity of steam, can be regulated precisely.

What is claimed is:

1. A steam iron, comprising:

a housing;

a handle mounted on the housing;

a water tank arranged in the housing;

an evaporation chamber arranged in the housing;

a drip valve arranged between the water tank and the evaporation chamber so as to feed water from the water tank to the evaporation chamber in order to produce steam, the drip valve having a valve rod with an angled end; and an adjustment part mounted in the handle and operatively connected to the valve rod, the adjustment part being formed as a wheel segment having bearing pins and a sliding track which acts as a guide for he angled end of the valve rod, the sliding track being eccentrically and helically in relation to the bearing pins and being provided with latching grooves, the angled end of the valve rod being engagable in the latching grooves.

2. A steam iron as defined in claim 1, and further comprising a prestressing spring mounted in the housing so as to grip over the valve rod to force the end of the valve rod in one of the latching grooves in a self-locking manner.

3. A steam iron as defined in claim 1, and further comprising a grip part integrally formed on the adjustment part.

* * * * *